US007169349B1

(12) United States Patent
Koffron et al.

(10) Patent No.: US 7,169,349 B1
(45) Date of Patent: Jan. 30, 2007

(54) METHOD AND APPARATUS FOR DELIVERING METALLURGICALLY IMPROVED MOLTEN METAL

(75) Inventors: Robert J. Koffron, Farmington Hills, MI (US); Ross A. Jacobs, Snowmass, CO (US)

(73) Assignee: Tetron, Inc., Farmington Hills, MI (US)

( * ) Notice: Subject to any disclaimer, the term of this patent is extended or adjusted under 35 U.S.C. 154(b) by 296 days.

(21) Appl. No.: 10/276,625

(22) PCT Filed: May 17, 2000

(86) PCT No.: PCT/US00/13621

§ 371 (c)(1),
(2), (4) Date: Jun. 13, 2003

(87) PCT Pub. No.: WO01/88209

PCT Pub. Date: Nov. 22, 2001

(51) Int. Cl.
*C21B 3/04* (2006.01)

(52) U.S. Cl. ..... 266/45; 266/227; 266/230

(58) Field of Classification Search ..... 266/45, 266/227, 230

See application file for complete search history.

(56) References Cited

U.S. PATENT DOCUMENTS 4,471,950 A 9/1984 LaBate (Continued)

FOREIGN PATENT DOCUMENTS

DE 40 25 605 A 2/2002

(Continued)

OTHER PUBLICATIONS

PCT/US 00/13621 International Search Report.—Jan. 30, 2001.

*Primary Examiner*—Scott Kastler
(74) *Attorney, Agent, or Firm*—Brooks Kushman PC

(57) ABSTRACT

A method and an apparatus for enhanced metallurgical processing of molten metal includes an enclosable ladle chamber (23) for reducing the escape of heat during transport of the ladle from a manufacturing vessel such as a furnace (13) to an intermediate processing (15) or refining station or during processing or transport to a receptacle vessel such as a tundish (17). The method comprises introducing a refractory body into the ladle chamber (23), the body having an adjusted specific gravity having a reduced steel ballast to refractory material ratio that is less than required for a specific gravity required to buoyantly support the body in the molten metal. Preferably, the ratio provides a specific gravity greater than the specific gravity required to buoyantly support the body entirely in the slag layer. The method includes enclosing the ladle (22) for example, with a lid (90) and maintaining said refractory body in said ladle until substantially termination of the discharge of the molten metal from the vessel. Preferably, the method also includes intermediate refining such as introducing a balancing composition to the ladle before enclosing. The ratio of steel ballast and refractory material used to achieve the preferred specific gravity may also be adjusted in conjunction with other temperature-resistant or corrosion-resistant changes to the refractory body. For example, high temperature alumina may be used as a refractory material in a higher degree than in previously known bodies, a high temperature cement may be used to join the refractory material and ballast components, and a non-wetting agent made of carbonaceous or siliceous material may reduce deterioration of the body during the extended period of steel and slag contact in the ladle.

19 Claims, 2 Drawing Sheets

U.S. PATENT DOCUMENTS

| | | | | |
|---|---|---|---|---|
| 4,799,650 | A * | 1/1989 | Labate | 266/227 |
| 4,854,550 | A | 8/1989 | Daussan et al. | |
| 5,044,610 | A * | 9/1991 | Koffron | 266/45 |
| 6,165,926 | A * | 12/2000 | Kriechbaum et al. | 501/127 |

FOREIGN PATENT DOCUMENTS

| | | | |
|---|---|---|---|
| JP | 54 042305 | A | 4/1979 |
| JP | 63 180350 | A | 7/1988 |

* cited by examiner

METHOD AND APPARATUS FOR DELIVERING METALLURGICALLY IMPROVED MOLTEN METAL

FIELD OF THE INVENTION

The present invention relates to a method and apparatus for enhanced metallurgical processing of molten metal compositions during transfer and delivery of molten metal.

BACKGROUND ART

In traditional metal alloy production, the ingredients for making a predetermined composition of metal are introduced to a furnace such as a basic oxygen furnace or an electric arc furnace, in which the constituents liquify and mix to form a molten metal pour. A layer of slag including impurities and catalysts is carried at the top of the molten metal layer. The molten metal is then discharged to a ladle for transport to an intermediate processing station or another production facility such as strand or sheet processing. At the production facility, the metal is discharged from the ladle to a vessel such as a tundish. While the processing stations may be provided with heat sources to maintain a liquid mixture once the pour has reached the processing destination, a substantial amount of heat was lost from the previously known open-topped ladles.

In order to address energy conservation concerns, it has been found to be useful to enclose the ladles during the transporting of molten metal from the furnaces to the processing equipment and during processing. Moreover, another recent innovation has been to enhance the metallurgical composition of the pour by adding metallurgical enhancements to the slag layer or the molten metal while heat energy is being maintained or adjusted in the ladle. Unfortunately, while closure of the ladle chamber permits metallurgical enhancement even during transport of molten metal from the furnace to a processing station or production facility, the prolonged period of the processing conditions, including heat and inaccessibility, does not permit previously known pour control techniques to be employed with success in these vessels.

For example, previously known techniques for controlling discharge from the vessel wherein a refractory plug is positioned and lowered over the nozzle by mechanical arms, as in a stationary furnace, cannot be employed with the closed vessels. Moreover, previously known refractory bodies such as that taught in U.S. Pat. No. 4,601,415 to Koffron cannot be introduced into a closed vessel when the level of molten metal in the vessel approaches the critical level at which a vortex forms over the discharge nozzle. Moreover, the previous refractory bodies formed with a specific gravity designed solely so that they are buoyantly supported in the melt may deteriorate rapidly under prolonged exposure to the ladle conditions and could not complete their intended function under prolonged contact with the molten metal and the slag layer interface.

DISCLOSURE OF THE INVENTION

The present invention overcomes the above-mentioned disadvantages by providing a method and apparatus for extending processing of the molten metal and improving the amount of improved quality metal discharging from a vessel after enhanced processing. In general, the process of metallurgically improving metal pouring processes is combined together with enhanced delivery involving closing the metal pouring vessel with a cover, preferably after initiating intermediate refining, such as by introducing a balancing composition to achieve a target equilibrium composition in the vessel. The method comprises introducing a specially constructed refractory body, and maintaining the metal pour, preferably with the balancing composition, and a refractory body in the vessel, until discharge of molten metal is terminated. A prolonged period of refractory body maintenance is assisted by a specially constructed vortex inhibitor in which a refractory composition body shaped to fit within a ladle has an adjusted specific gravity, the adjusted specific gravity having a reduced steel ballast to refractory material ratio less than the ratio for a specific gravity required to buoyantly support the body in the molten metal at the interface of slag and molten metal in the ladle. For preferred alignment at the interface, the ratio is also preferably greater than the ratio for a specific gravity required to support the body entirely in the slag layer. Preferably, the refractory body also includes a penetration inhibitor resisting deterioration of the body throughout the residence time in the metal.

As a result, the present invention provides a refractory body that resists deterioration throughout the prolonged exposure to the molten metal, to the slag and to the retained heat. The present invention provides a substantially more robust structure that maintains integrity of the body so as to provide vortex reduction in pouring operations previously inhospitable to the previously known slag controlling or yield-improving technologies. In addition, the covered ladle provides an improved transfer mechanism and an enhanced metallurgy production system that permit greater precision in the production of alloys, improved production or utilization quantities of high quality metals and greater energy efficiency than previously known production systems.

DETAILED DESCRIPTION OF THE PREFERRED EMBODIMENT

Figure 1:
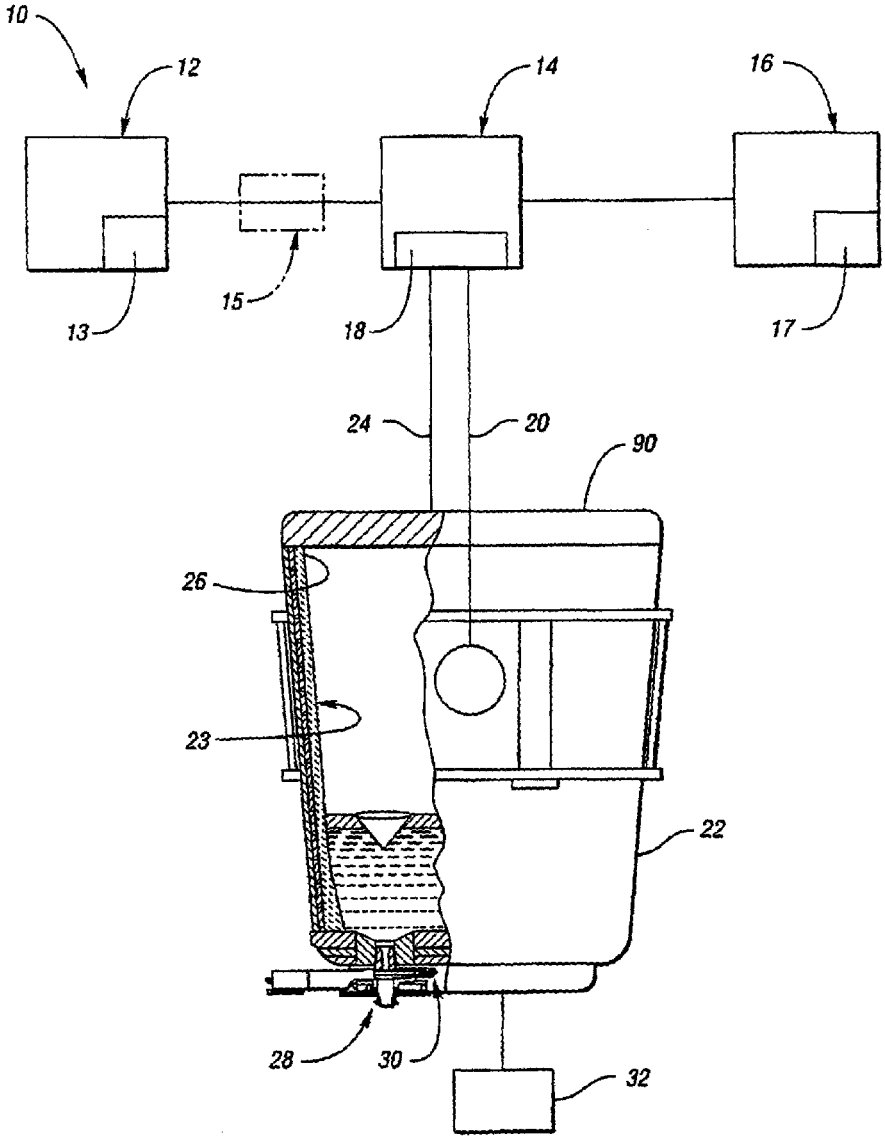
FIG. 1 is a partly diagrammatic view of a metal production processing facility including a sectional representation of a transfer vessel employed in the system.

Referring to FIG. 1, a metal production system 10 is shown comprising a formation facility 12, a transfer mechanism 14 and a processing facility 16. The formation facility 12 may include a basic oxygen furnace, an electric arc furnace or other alloy melting facility, at which the basic raw materials for metal production are introduced to a furnace and heated to melt and intermix the raw materials for production of a particularly desired composition of metal. Although the quality and particular composition of the metal formed at the furnace 13 is consistent with the original raw materials introduced to the furnace, impurities in each of the ingredients may cause variations between the desired metal composition and the requirements of metal to be used in a processing facility 16. The processing facility 16 may be a bulk production facility, for example, a strand-making facility including a tundish that receives molten metal for delivery as a strand, or a sheet or other shaped commodity of molten metal that hardens for subsequent reheating, shaping, forming or processing operations. Nevertheless, the complexity, size and functional differences between the equipment 12 and 16 renders it necessary to use a transfer mechanism 14 by which the molten metal is unloaded from the formation facility 12 and delivered to an intermediate processing station 15 or to the processing facility 16 or between the station and the facility.

The invention is also well adapted for systems 10 in which an intermediate processing station 15, such as a secondary refining facility, may be included between the production facility 12 and the processing facility 16. In general, the furnace produces steel to a target chemistry and temperature range. That steel is then poured into a ladle and transported to a ladle refining furnace, stirring station, or degassing station—each can be described as an intermediate processing station—useful in adjusting the chemistry of the metal. The chemistry and temperature are then adjusted to a far more exact, narrow range based upon the desired grade that is being produced, which is generally driven by customer orders. Accordingly, when preferred, every heat (pour) discharged from the furnace may be basically to the same chemistry range. Then all chemical adjustments for the various grades to be produced are made at the ladle refining furnace. As an example, adding such material as Ca, Mn, Al, MgO, Si and Calcium Carbide; bubbling Argon through the steel; and re-heating it with electrodes or other re-heating processes may be used to improve content compliance with specifications. Preferably, the intermediate processing occurs before introduction of a refractory body when the body is not restrained in position over a discharge nozzle by extrinsic means.

In general, the transfer mechanism 14 includes a displacer 18 for transferring a molten metal load. In the preferred embodiment, the displacer 18 includes a ladle 22 carried by a crane 20 or other conveyance, and can include as well a crane 24 for a lid 90 for the ladle 22. In general, the crane 20 delivers the ladle to the formation facility 12 so that the open top 26 of the ladle 22 receives discharge from a nozzle or other discharge opening of a furnace 13 at the facility 12. Likewise, the ladle includes a discharge nozzle 28 that enables the contents to be discharged to a tundish or other receiving vessel at the processing facility 16. Preferably, the nozzle 28 includes a gate valve 30. The gate valve 30 is responsive to a control 32.

The control 32 may include a sensor at the nozzle for detecting when the flow through the nozzle is throttled, i.e., reduced in volume by a vortex inhibitor or other plug, to terminate discharge of metal from the ladle, preferably before slag floating on top of the molten metal mixes with the molten metal layer. Nevertheless, when the vortex inhibitor body is used, the transition from metal to slag is nearly instantaneous because the body has nearly eliminated metal-slag mixing by eliminating the vortex. The transition happens very quickly and is more nearly discrete. The discharge is usually to be terminated when slag is observed by workers or otherwise automatically sensed, although terminating in response to when throttling is observed may not maximize yield. The throttling effect, or the transition from metal to slag flow, can be observed by workers or otherwise automatically sensed. In addition, the response of the control 32 may be manually or automatically initiated in response to the detection of the throttling or the detection of slag content.

Figure 2:
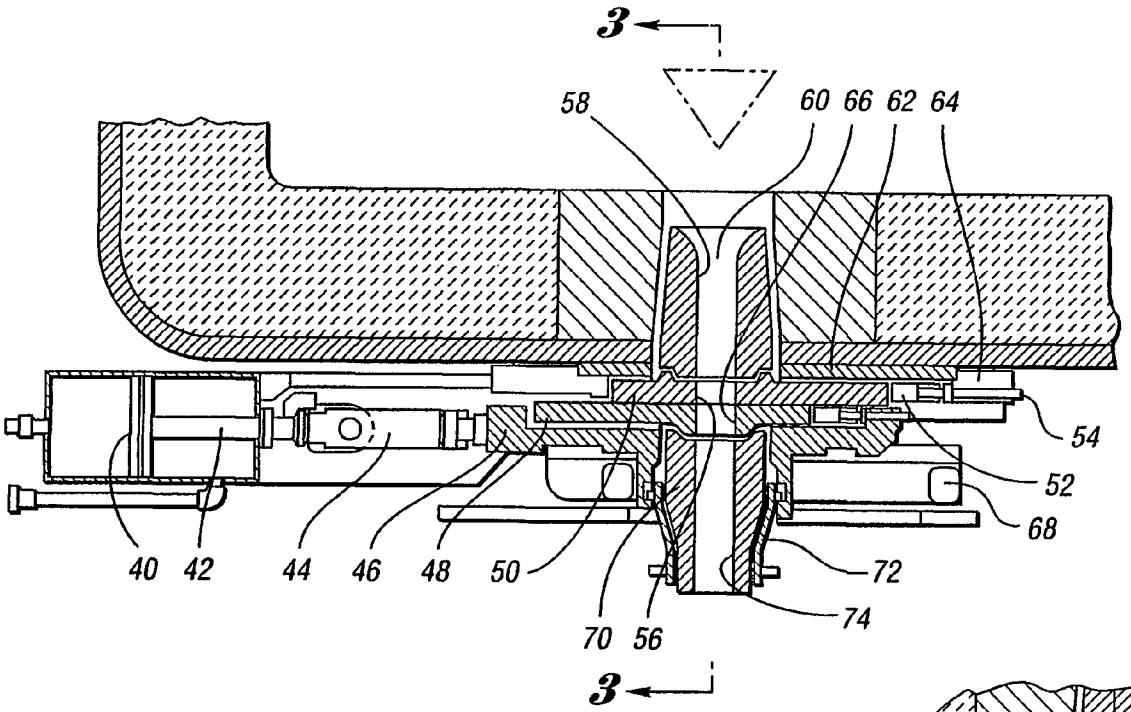
FIG. 2 is an enlarged sectional elevation of a ladle bottom with a gate valve nozzle arrangement for discharging molten metal.

As best shown in FIG. 2, the response of terminating flow may be handled by hydraulic-mechanical mechanisms responsive to the detection of throttling. For example, a hydraulic cylinder 40 whose piston 42 is coupled with a guide piece 44 engages a slide case 46. The slide case 46 includes a recess carrying a slide plate 48 made of refractory. The slide plate 48 slides adjacent to a bottom plate 50, also made of refractory and carried in the brick setting metal 52. The brick setting metal 52 includes four side supports for the plate and an adjustment mechanism with a set bolt 54 to adjust the position of the bottom plate 50 with respect to the nozzle inserts when the brick setting metal is mounted to the ladle, so that the bottom plate opening 56 is aligned with the opening 58 in a nozzle insert 60. A bottom plate supporter 62 is mounted or welded to the ladle shell and is engaged with slide plate housing 64 bolted to the bottom plate supporter 62.

Figure 3:
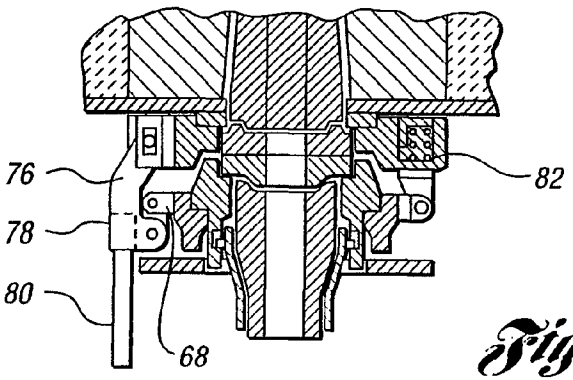
FIG. 3 is an enlarged sectional elevation from the perspective of line 3—3 in FIG. 2.

Opening 66 in the slide plate 48 is displaced by the slide case in response to operation of the hydraulic cylinder 40 in a well known manner. In addition, the slide case is supported in a clamp 68 by a clamp arm 76 (FIG. 3) for retaining a chute nozzle 70 within a chute nozzle case. Chute nozzle 70 also includes an opening 74 which may be aligned with the openings 66 in the slide plate 48, 56 in the bottom plate 50, and the nozzle opening 58 in the insert nozzle 60. The chute nozzle case 72 is slid into and rotated into position with bayonet locks into the slide case 46. A clamp arm 76 includes an over center toggle which moves in response to a clamp lever 80 to retain the chute nozzle 70 in alignment with the insert nozzle 60 and the gate valve opened by displacement of the slide plate 48 with respect to the bottom plate 50. A coil spring 82 mounted on a least thermally influenced position of the gate supports facial load on the sliding brick 48.

The open top 26 of the ladle is closed by a lid or cover 90 which may be made of a refractory material or a refractory coated shell. The cover 90 is carried and positioned by a crane 24. The cover 90 maybe positioned or it may be hinged to the vessel to enclose the internal chamber 23 of the ladle between the closed nozzle 28 and the open top 26. Such covers have previously been known for use in retaining heat within the chamber 23. Moreover, in view of the heat retained in the ladle, enhanced metallurgy adjustments could be made to the contents of the ladle during the transport time. In particular, before the cover 90 is positioned on the open top 26 of a ladle 22, additional alloys constituents and catalysts can be introduced to the chamber 23 so that the contents can be refined. In particular, the molten metal composition in the chamber 23 may be maintained within a desired alloy or combination range while the slag layer continues to provide catalysts that remove impurities from the molten metal and avoids reintroduction of impurities to the molten metal content.

Preferably, adjustments are not made during the transport time, but rather while the ladle is at the intermediate processing station 15 or secondary refining facility. The ladle is not released from the intermediate processing station 15 or secondary refining facility for transport to the production facility until the steel chemistry and temperature have reached a narrow target range. Preferably, the refractory body is inserted into the ladle after all adjustments have been made at the intermediate processing station 15 or secondary refining facility. Preferably, the intermediate processing occurs before the cover 90 is put on top and more preferably, before the introduction of the refractory body, either at the refining facility, during transport to the production facility or at the production facility.

As a result of the closing of the open top 26 and the nozzle 28 of the ladle 22, the chamber 23 is inaccessible to additional enhancements, such as the use of a vortex inhibitor to control the intermixture of the slag layer with the molten metal layer when discharge of the metal is desired. Moreover, upon reaching the destination vessel 17 of processing facility 16 by displacement mechanism 24, the cover 90 may not be opened until the pouring of molten metal has been substantially or entirely completed. In some plants, the cover is removed from the ladle when the ladle is almost empty. This maybe done when the discharging ladle is nearly empty, and the next full ladle is brought to the continuous caster uncovered.

As a result, the introduction of a vortex inhibitor to a ladle that is to be covered represents a substantially different time period during which the refractory body is subjected to contact with the molten metal and the slag layer than in previously known uses. As a result, unlike previously known vortex inhibitors, the specific gravity and refractoriness of the refractory body is adjusted to provide proper results at the pouring step which occurs substantially after filling, and after an extended time of enclosed transport. Preferably, the pour occurs after intermediate processing. Although the pouring step can range from 35–180 minutes in duration, the refractory body must provide proper results during the last portion, for example, 10 minutes, of the pouring step.

In one example, while refractory bodies with specific gravity ranges of 4.8 to 5.2 were commonly used to maintain separation between the slag layer and the molten metal layer in furnaces during a period of about two to ten minutes for inhibiting formation of a vortex at the critical height level of molten metal in the furnace until the throttling or other termination point used to terminate the flow from the discharged nozzle, such bodies were ineffective in the closed ladle environment. As a result, several changes were made to contribute to longevity of the vortex inhibitors in a ladle environment. In particular, alumina ($Al_2O_3$) was changed to a high temperature range and increased in proportion to the remaining constituents from about 45% by weight to about 70% by weight. In addition, the constituents were mixed with high temperature cement, such as 1% to 2% by weight of a, for example, calcium aluminate cement or equivalent high strength or low water cement.

Moreover, the ratio of steel ballast to refractory material was reduced to give a specific gravity, preferably of about 3.7, but preferably within the range of substantially 2.7–4.5. In addition, a non-wetting agent preferably in the form of a particulate carbonaceous material was introduced to the refractory mixture to reduce the amount the body would be penetrated by molten metal or slag and deteriorated, eroded, corroded, broken down, or dissolved by the slag or the molten metal, during the extended steel and slag contact periods. Nevertheless, other mineral-based compounds, but preferably silicates, borosilicates and other glass could be added as penetration inhibitors.

Typically, more expensive refractory materials such as MgO may be used, but may be avoided where expenses are to be limited. In any event, the refractory body includes a mixture of steel ballast and refractory material and has an adjusted specific gravity from previously known refractory body inhibitors. Adjustment may include changes due to desired target chemistry of the metal, for example, stainless steel fibers, silicon carbide, magnesite refractories, chrome refractories, zircon refractories, zirconia refractories, tabular alumina refractories or mallite refractories may be included. Adjustment may also be determined by bulk density specifications and life expectancy in molten steel. Preferred ranges of steel ballast with a per cubic foot weight of 300–400#, preferably in a range of 30% to 80% by weight, and 30% to 80% by weight refractory material of the types disclosed above. A binder of high temperature cement, at least capable of withstanding 1000° F., but preferably capable of withstanding 2400° F. to 3300° F. without substantial deterioration may be included, preferably 2%–12% by weight.

The reduced steel ballast to refractory material ratio has a specific gravity less than that required to buoyantly support the body in the molten metal at the slag layer interface in the ladle, but preferably greater than that required to buoyantly support the body in the slag layer. As a result, the specific gravity and refractoriness (ability to withstand or survive in a liquid metal environment) adjustments have resulted in refractory bodies that are still maintained in workable shape to perform vortex inhibition and throttling functions even after the end of a prolonged time exposure to the enclosed environment of a ladle transferring molten metal from a furnace to a receptacle vessel. The change in the specific gravity of the body may also ensure that the body is not sucked to the discharge nozzle too early.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A vortex inhibitor for extended processing of molten metal during delivery by a ladle (22) having an opening and a closeable cover (90) over said opening and a discharge nozzle (28) in said ladle, the inhibitor comprising:

a refractory body shaped to fit within said ladle opening;

said refractory body including intermixed steel ballast, refractory material and a penetration inhibitor resisting deterioration of said body by slag and molten metal; and said refractory body having an adjusted specific gravity, said adjusted specific gravity defined by having a reduced steel ballast to refractory material ratio less than the ratio required for a specific gravity required to buoyantly support the body in said molten metal in said ladle wherein said adjusted specific gravity is 2.7–4.5.

2. The invention as described in claim 1 wherein said penetration inhibitor comprises a particulate carbonaceous material added to said mixture.

3. The invention as described in claim 1 wherein said penetration inhibitor is silica or silicate based glass.

4. The invention as described in claim 1 wherein said refractory material comprises fire clay.

5. The invention as described in claim 1 wherein said refractory material includes alumina.

6. The invention as described in claim 5 wherein said alumina content is 45% to 70% of said refractory material.

7. The invention as described in claim 1 and comprising a high temperature binder in said mixture.

8. The invention as described in claim 7 wherein said high temperature binder is 1–2% by weight of said mixture.

9. The invention as described in claim 7 wherein said binder is calcium aluminate cement.

10. The invention as described in claim 1 wherein said adjusted specific gravity is 3.7.

11. A method for improving metal pouring processes with a metal pouring vessel (22) containing molten metal and a discharge opening (28) in said vessel comprising:

introducing a refractory body having an adjusted specific gravity, said refractory body including intermixed steel ballast and refractory material, and said adjusted specific gravity defined by a reduced steel ballast to refractory material ratio less than required for a specific gravity required to buoyantly support said body in the molten metal wherein said adjusted specific gravity is 2.7–4.5;

closing the metal pouring vessel with a cover;

maintaining said refractory body enclosed in said vessel until discharge of said molten metal is terminated.

12. The invention as described in claim 11 and further comprising conducting intermediate processing in said vessel.

13. The invention as described in claim 12 wherein said intermediate processing comprises ladle refining.

14. The claim as described in claim 13 wherein said refining comprises introducing a balancing composition to the vessel before said enclosing step.

15. The invention as described in claim 12 wherein said refining step comprises degassing.

16. The invention as described in claim 12 wherein said refining step comprises stirring.

17. The method as described in claim 11 and further comprising restricting deterioration of said body by treating said body with a non-wetting agent prior to said introducing a refractory body step.

18. The invention as described in claim 17 wherein said treating is mixing siliceous material with refractory material while forming the body.

19. The invention as described in claim 11 wherein said introducing step includes a refractory body having a specific gravity greater than that required to buoyantly support the body entirely in the slag layer.

* * * * *

UNITED STATES PATENT AND TRADEMARK OFFICE

CERTIFICATE OF CORRECTION

PATENT NO. : 7,169,349 B1
APPLICATION NO. : 10/276625
DATED : January 30, 2007
INVENTOR(S) : Robert J. Koffron and Ross A. Jacobs It is certified that error appears in the above-identified patent and that said Letters Patent is hereby corrected as shown below:

Column 7, Line 16, Claim 15

Delete "12" and replace with -- 13 -- .

Column 8, Line 1, Claim 16

Delete "12" and replace with -- 13 -- .

Signed and Sealed this

Twenty-fourth Day of April, 2007

JON W. DUDAS
*Director of the United States Patent and Trademark Office*